United States Patent [19]

Hollweck et al.

[11] Patent Number: 4,703,301

[45] Date of Patent: Oct. 27, 1987

[54] THERMALLY-CONTROLLED ELECTRICAL SWITCHING ELEMENT, PARTICULARLY TEMPERATURE REGULATOR OR TEMPERATURE LIMITER

[75] Inventors: Walter Hollweck; Karlheinz Eberl, both of Nuremberg, Fed. Rep. of Germany

[73] Assignee: Inter Control Hermann Kohler Elektrik GmbH & Co. KG, Nuremberg, Fed. Rep. of Germany

[21] Appl. No.: 858,207

[22] Filed: May 1, 1986

[30] Foreign Application Priority Data

May 4, 1985 [DE] Fed. Rep. of Germany ..... 3516041
Jul. 13, 1985 [DE] Fed. Rep. of Germany ..... 3525093

[51] Int. Cl.[4] ..... H01H 37/54; H01H 37/70

[52] U.S. Cl. ..... 337/367; 337/348; 337/354

[58] Field of Search ..... 337/367, 358, 354, 348, 337/91, 72, 56

[56] References Cited

U.S. PATENT DOCUMENTS 2,361,162 10/1944 Arnold ..... 337/348
3,087,033 4/1963 Dales ..... 337/348
3,885,222 5/1975 Manecke ..... 337/367
4,053,859 10/1977 Hollweck ..... 337/91

*Primary Examiner*—Harold Broome
*Attorney, Agent, or Firm*—Robin Blecker & Daley

[57] ABSTRACT

A thermically controlled electrical switching element which is in the form of a temperature regulator or a temperature limiter. On a socket are arranged, in parallel orientation, a bimetallic spring plate, and a steel plate deflectable to both sides. The bimetallic spring plate is attached at its periphery in such a way that centrally, above a transition temperature, it can deflect in a first direction, and below a reverse transition temperature, it can deflect in a second, opposite direction. The steel plate attached at the rim together with the bimetallic spring plate, upon deflection of the spring plate, is also displaced in the first direction, and thereby, by means of a control element bearing upon its center, opens a switch contact interrupting the current flow to an electrical heating element. In order to enable manual opening and closing of the switch contact pair within the switching element, in a simple manner, a control arm is placed in the rim area of the steel plate, whose control end is rigidly attached to the rim area of the steel plate, and whose actuating end either constitutes a manually operable push button, or is connected to such a push button.

24 Claims, 15 Drawing Figures

Fig. 9
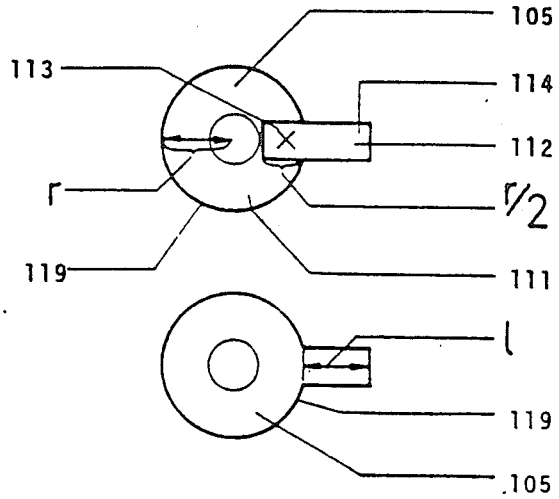
Fig. 10
Fig. 11
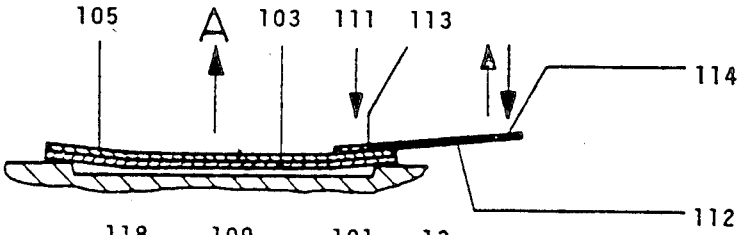
Fig. 12
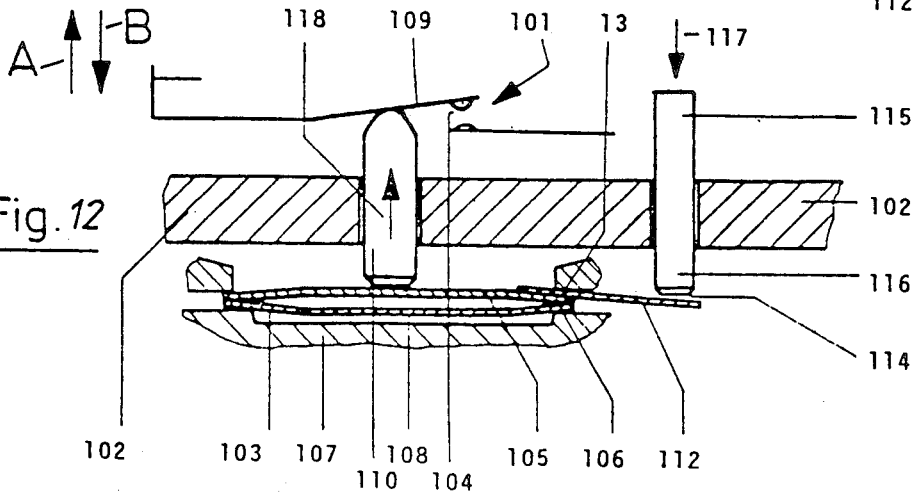

THERMALLY-CONTROLLED ELECTRICAL SWITCHING ELEMENT, PARTICULARLY TEMPERATURE REGULATOR OR TEMPERATURE LIMITER

FIELD OF THE INVENTION

The invention relates to a thermically controlled switching element, in particular a temperature regulator or temperature limiter.

BACKGROUND OF THE INVENTION

Switching elements of this kind are utilized whenever it is desired in a relatively simple way to regulate a temperature around a setpoint which cannot be adjusted by the user, and thus is prescribed by the mechanism, or to accomplish a temperature limitation. Typical areas of application for such thermically controlled electrical switching elements are household appliances, such as electric cooking pots, friers, hairdriers, irons (simple irons without user-adjustable temperature), and the like. The essential elements of switching elements of this kind are a bimetallic spring plate and a switch contact which can be connected into the current path of a heating element, which are arranged together in or on a socket. The bimetallic spring plate is supported at its periphery in such a way that above a transition temperature it can deflect in a first direction A, and below a second transition temperature, it can deflect in a second direction B. The moving part of the switch contact is coupled to the spring movement of the center of the bimetallic spring plate through a control element (such as an axially displaceable pin), in such a way that upon deflection of the bimetallic spring plate in one of the directions (for example A), the contact is opened.

Together with the bimetallic spring plate is installed another steel plate, that with deflection of the bimetallic spring plate in the first direction, is also movable or deflectable in this first direction. The control element engages it at the center, and, depending upon the position of the spring plate, opens the switch contact.

From U.S. Pat. No. 4,053,859, for example, a temperature limiter is known, in which after accomplishment of thermic disconnection of the switch element, the switch contacts can be reclosed manually, by pressing a pin extending axially. If there is to be provision for manually shutting off the device equipped with this switching element, an additional, external switch must be installed in the current path.

SUMMARY OF THE INVENTION

The invention is based upon the development of thermically controlled electrical switching element wherein a manual opening and closing of the switch contact pair in the switching element is made possible, in a simple way and advantageous refinements are made available.

First, the invention utilizes to advantage the spring properties of the steel plate, in order to bring the switch contact manually to a permanently opened or permanently closed position, with the opening of the switch contact occurring in a snap fashion. Of especially advantageous effect is the transfer of the movement of a shutoff button on the steel plate. In the peripheral region of the plate is attached a control arm, which, according to the nature of a two-armed lever supported at the rim end, forces the spring plate from one deflection position to the other. A central actuation of the steel plate (or the bimetallic plate) by any centrally impacting control mechanism can be eliminated, so that the spring characteristics of the plate are not negatively influenced. The quick force movement of the shutoff is brought about by the plate center, so that a snap interruption of the contact is ensured both for thermic release and manual release. For manual release, the peripheral area of the plate influenced by the displacement arm is deflected in the opposite direction until the center of the plate follows in spring fashion, and opens the contact.

DESCRIPTION OF THE DRAWINGS

The invention is described in greater detail with reference to examples of embodiment shown in the drawings, which show:

in FIG. 9, a monostable steel plate with control arm of a piece with it;

in FIG. 10, a monostable steel plate with control arm of a piece with it;

in FIG. 11, a cutaway through a bimetallic spring plate, and parallel steel plate against it, in position B;

in FIG. 12, a schematic cutaway representation similar to FIG. 11, with indicated control element, switch contact, shutoff mehanism, regulator socket and base plate;

DESCRIPTION OF THE PREFERRED EMBODIMENTS

Figure 5:
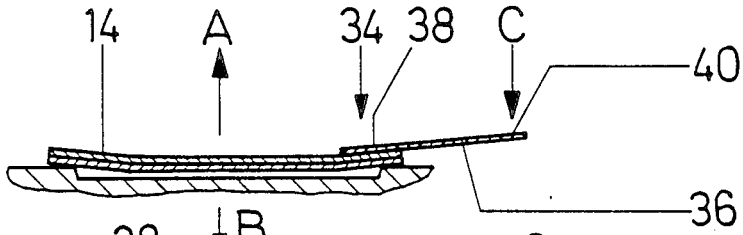
in FIG. 5, an enlarged cutaway representation of the bimetallic plate and steel plate, in the "on position"
Figure 6:
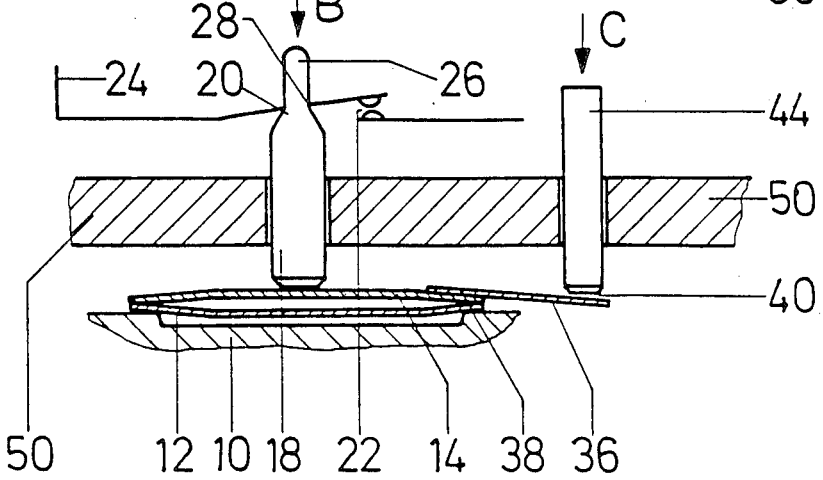
in FIG. 6, an enlarged cutaway representation, with control elements led into a housing component, with the steel plate in the "off position"

The temperature limiter according to FIG. 1 consists essentially of a housing 10, in which are placed, lying parallel against one another, an essentially circular bimetallic plate 12, and a bistably deflecting steel plate 14, whereby the bimetallic spring plate 12 is supported at its periphery 16 in such a way that above a transition temperature, it deflects in a first direction (direction A according to FIG. 5), and below a spring-back temperature, deflects in a second, opposite direction (direction B). The steel plate 14 attached peripherally together with the bimetallic spring plate (in the following referred to as the spring plate 12), with the deflection of the spring plate in the first direction A is also moved in this directions, and thereby presses a control element 18 in the direction A, which at its end 20 away from the plate, lifts the movable contact of a switch contact 22, connected between connection contact lugs 24 projecting out of the housing 10. More precisely speaking, the control element with a tapered end 26, passes through an opening 28 in the movable contact, with the tapered end 26 projecting out of the upper side of the housing, and serves as a turn-on button. By means of the tapered end 26, a central pressure can be exerted manually in the second direction (B) on the center of the steel plate 14, whereby the contact 22 is closed, and the steel plate 14 springs back into the connection-closed position shown in FIG. 5.

Figure 1:
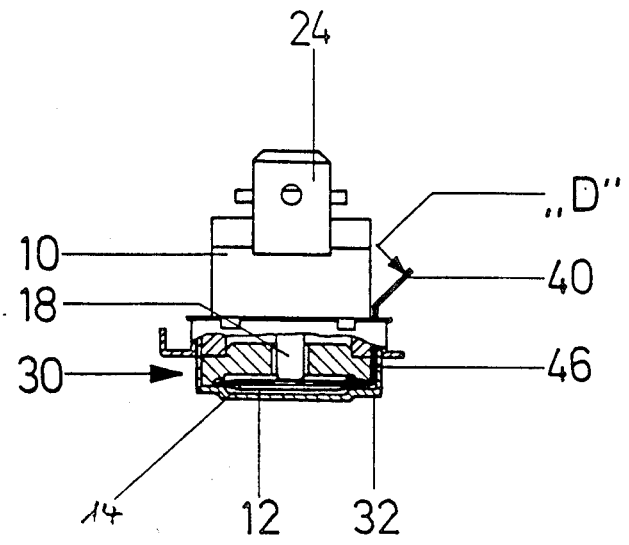
in FIG. 1, a temperature limiter of a first form of embodiment, partially cut away.
Figure 2:
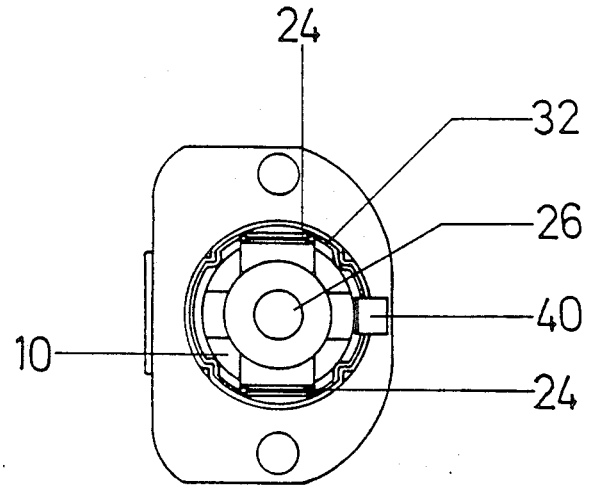
in FIG. 2, a top view of the temperature limiter of FIG. 1.
Figure 3:
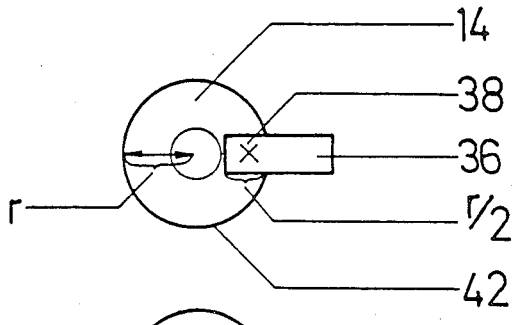
in FIG. 3, a top view of a steel plate with a separate attached control arm.
Figure 4:
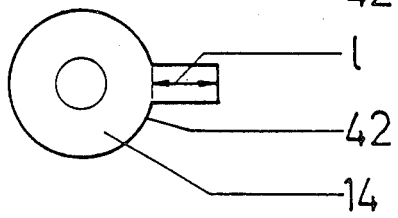
in FIG. 4, a top view of a steel plate with a control arm formed as an integral single piece.

As also is clear from FIG. 1, the lower portion 30 of the housing 10 is surrounded by a pot-shaped metallic housing section 32, which serves for heat transfer inward to the spring plate 12 lying against the interior of the housing component 32.

As can be seen especially in FIG. 1 and FIGS. 3–6, in the peripheral zone 34 of the steel plate 14, a resetting arm 36 is provided, whose control end 38 is rigidly bound to the rim area 34 of the plate 14, and whose actuating end 40 is constituted as, or is connected to, a shutoff push button. The force on the actuating end 40 of the resetting arm 36 necessary for opening of the contact 22, is exerted in the direction of the arrow "C" according to FIG. 5.

The control end 38 of the resetting arm is attached flush upon the rim zone 34 of the plate 14, and extends inward into the plate surface to about half the radius, r/2. According to FIGS. 3–6, the resetting arm 36 extends radially from the plate rim 42, with the length "l" of its extension from the plate rim 42 corresponding approximately to the plate radius "r."

Figure 8:
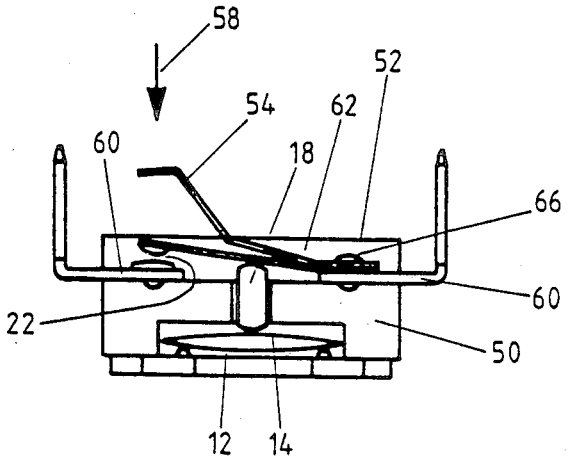
in FIG. 8, the temperature limiter according to FIG. 7, in cutaway along the line VIII—VIII.
Figure 7:
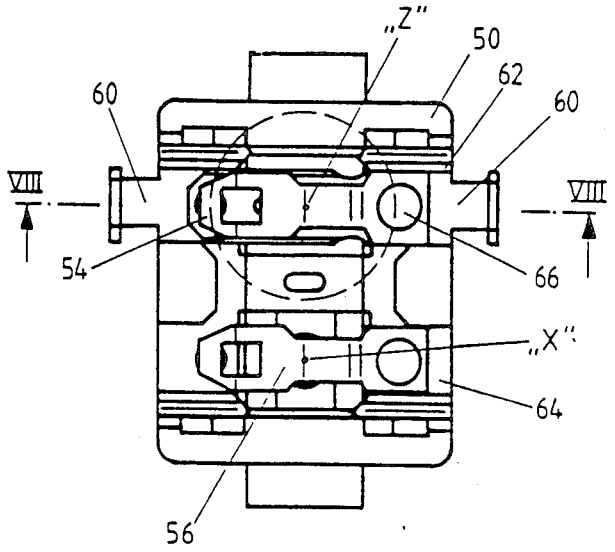
in FIG. 7, a top view of a temperature limiter of a second form of embodiment.

The actuating end 40 of the resetting arm 36 is manipulated by a movable resetting element 44 in the housing 10 (see embodiment according to FIGS. 7 and 8). However it is also possible for the resetting arm 36 to extend essentially at right angles to the surface of the plate 14, as represented in FIG. 1. Here, the actuating end 40 of a resetting arm 36 bent in a Z-shape projects out of the pot-shaped metallic housing section 32 enclosing the bimetallic plate and steel plate. Through the Z-shaped bending of the resetting arm 36, the second, or middle limb 46 of the "Z" extends approximately parallel to the cylindrical section of the metallic housing component 32, the first, or lower Z-limb is attached flat against the rim zone 34 of the steel plate 14, and for opening of the contact, the upper, or third Z-limb (actuating end 40) must be moved in the direction of the arrow "D" according to FIG. 1.

It is furthermore of importance that the resetting arm 36 consist of spring steel, so that during manual actuation of the actuating end 40, excessive hand forces are absorbed by spring action, and not transferred to the sensitive spring plate.

The temperature limiter according to the second example of embodiment according to FIGS. 7 and 8 displays approximately a flattened rectangular housing 50, in which the plates 12, 14 are attached eccentrically in such a way that the center of the plates lies approximately at the point "Z" in FIG. 7. The control element 18 also extends through the point "Z," and, as previously mentioned, strikes the center of the plate 14. The rim of the plates 12 and 14 is indicated in FIG. 7 by the dashed line.

The resetting arm 36 extends radially from the plate 14, as represented in FIGS. 3–6, and is placed within the housing in such a way that the actuating end 40 comes to lie below the position "X" according to FIG. 7. At this position is located the resetting element, which is arranged parallel to the control element 18 within the housing 50, and longitudinally displaceable.

On the housing surface 52 away from the plates 12, 14, are provided push buttons (on button 54, off button 56), which interact with the control elements 18 and 44. It is of importance that the direction of pressing both buttons 54 and 56 extends in the same direction as the direction 58.

In the example of embodiment represented in FIGS. 7 and 8, the connection contact lugs 60, the switch contact 22, and the "on" button 54 lie within a first recessed slot 62 in the housing, and the "off" button in a second recessed slot 64. All the elements are connected to the floor of the slot by rivets. As can be seen especially in the cutaway representation according to FIG. 8, the on button 54, configured as a spring tongue, the movable contact of the switch contact 22, and the connection contact lug 60, lying to the right in the drawing, are held to the bottom of the slot by a common rivet 66. In this way there results a nearly parallel orientation between the spring tongue "on" switch 54 and the movable contact of the switch contact 22, so that it is possible, by acting upon the "on" button 54 in the direction 58, to act upon the switch contact 22 in the direction of contact closure. In this way the contact is closed, and through the control element 18, the steel plate 14 is brought into the position shown in FIG. 5, insofar as the bimetallic plate 12 lies below its spring-back temperature.

The "on" button 54 and "off" button 56 are identical in configuration, and lie parallel to one another in their respective housing slots 62, 64. Both buttons 54, 56 with their middle regions press the respective control element 18, 44 in the direction of the plates 12, 14. Both buttons 54, 56 have their free ends standin8 outside of the housin8 slots 62, 64, and can be pressed into the slot by the upward-bending free end under spring action, without fear of destruction or bending of the switching elements.

In the following, reference will first be made to FIG. 12. There, a temperature regulator 101 is represented schematically, having a regulator socket 102, a bimetallic spring plate 103, a switch contact 104 which can be connected within the current path of a heating element, not represented, and a monostable steel plate 105. The bimetallic spring plate 103 is mounted to a base plate 107 at its rim area 106 in such a way that at its center, above a first transition temperature, it can be deflected in a first direction A, and below a second transition temperature, it can be deflected in the opposite direction B. In FIG. 12 is represented the bimetallic spring plate in position B.

The movable portion 109 of the switch contact 104 is connected with the center 108 of the bimetallic spring plate through a control element 110, in such a way that the switch contact 104 is pressed, upon deflection of the bimetallic spring plate in the direction A.

Between the control element 110 and the bimetallic spring plate 103, in an orientation parallel to the latter, lies the previously mentioned steel plate 105. This steel plate involves a so-called monostably deflecting steel plate, i.e. a steel plate which can be brought by manual action from a first deflection direction to a second deflection direction, however with removal of the manual action, returns by its own spring action to its original deflection direction.

In order to bring about this deflection movement, in the rim zone 111 a control arm 112 is attached, whose control end 113 is rigidly bound to the rim area of the steel plate 105, and whose actuating end 114 is engaged by a switching mechanism 115. In the example represented in FIG. 12, the switching mechanism 115 is configured as a push button with a self-holding function, which with its inner end pushes on the actuating end 114. If the switching mechanism 115 is pressed in the direction of the arrow 117, the steel plate 105 springs in the direction A, and thereby displaces the control element 110 in the direction of the arrow 118, and snaps open the switch contact 104. The bimetallic spring plate 103, in the case of this manual actuation, remains undisturbed in the deflection position B.

From FIG. 11 it is especially apparent how the bimetallic spring plate 103 and the steel plate 105, both in the rest position (position B), lie in parallel orientation against one another. If the bimetallic spring plate 103 changes to the deflection position A due to a temperature increase above the first transition temperature, it carries the monostable steel plate also into the position A. In other words, the steel plate undergoes a forced movement along with the bimetallic spring plate.

In FIGS. 9 and 10 are shown two examples of embodiment of the monostable steel plate.

As is especially clearly to be seen from FIG. 9, the control arm 112 with its control end 113 can be positioned flat upon the rim zone 111 of the steel plate; for example it can be welded or soldered. Its length "l" of extension beyond the plate rim 119 corresponds approximately to the radius "r" of the steel plate 105, and moreover the control arm extends to approximately half the radius, "r/2", inward over the plate. In FIG. 10 it is indicated that the control arm can also be configured as a single piece with the steel plate.

In the following, reference will be made to FIGS. 13 and 13*a*. There, a regulator is shown, in which the bimetallic spring plate and the steel plate are emplaced in a pot-shaped metallic housing component 130. The bimetallic spring plate 103 and the steel plate 105 lie in parallel orientation (as in the other embodiments) on the base 131 of the housing component 130, and the control element 132 extends at right angles to the middle plane of the bimetallic spring plate and the steel plate, and is conducted into an essentially circular socket component 133, which is completely surrounded by the housing component 130. In the upper part 134 of the regulator 105 is installed the switch contact, not represented in further detail, which (as in the other embodiments) is opened or closed by the control element 132 as a consequence of the deflection movements of the bimetallic spring plate and/or the steel plate. The connector lug 135 is connected to the switch contact.

Because it is useful for the pot-shaped lower housing component 130 to be as closed as possible in its lower region (it can be immersed in heat reservoirs, and thus very directly react to the heat there present), the control arm is bent essentially in a Z-shape, with the first limb of the Z lying flat on the rim area of the steel plate 105, or extending into it, the second limb 141 extends approximately parallel to the cylindrical section 135 of the housing component 130, and the third limb 142 projects out of the housing component 130 as an actuating end.

Figure 13A:
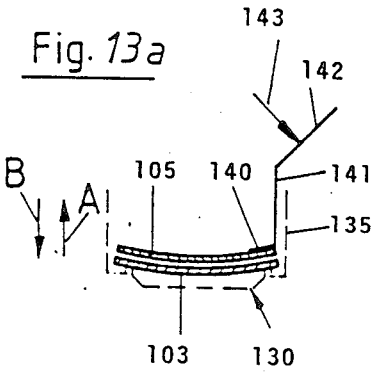
in FIGS. 13, 13*a*, a partial cutaway, partly schematized, through another regulator configuration.
Figure 13B:
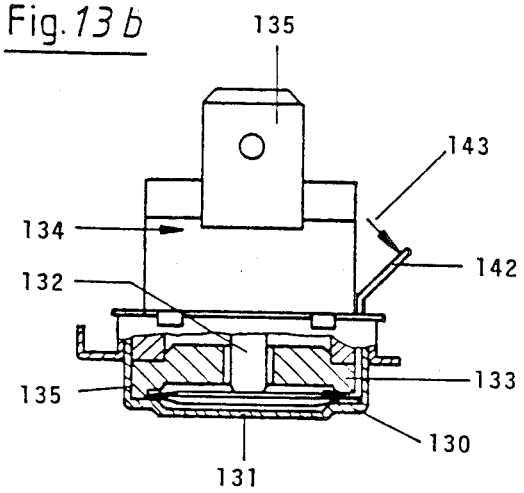

If the actuating end is pressed in the direction of the arrow 143 according to FIGS. 13 and 13*a*, the steel plate 105 (and it alone) springs from the deflection position B represented in FIG. 13*a* to the upward deflection position A.

Figure 14:
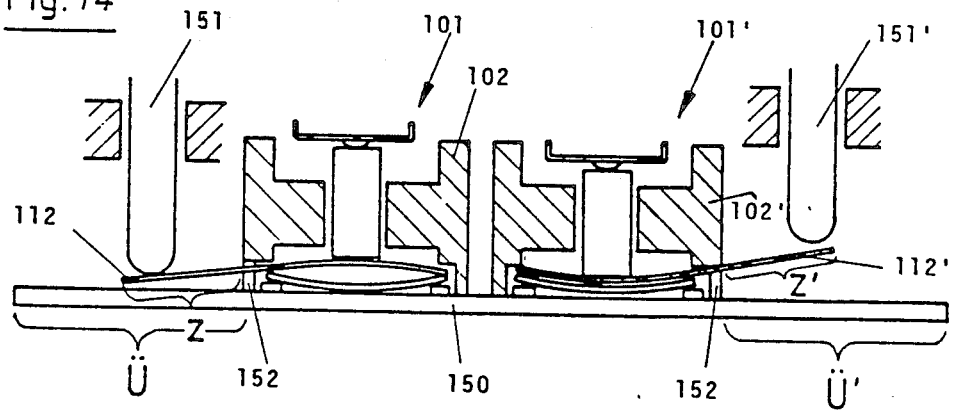
in FIG. 14, a cross section through a double regulator, whereby the left regulator component is in the manual shutoff position, and the right regulator is in the "on" position.

In the double regulator represented in FIG. 14, two regulators 101, 101' are installed on a common heat-conducting base plate 150. The switching mechanism 151, 151' in the example represented in FIG. 14 is again configured as an axially displaceable pin, and is suitable to engage the control arms 112, 112' projecting laterally out of the regulator sockets 102, 102', together or alternatively. Engagement in common means that the current path is interrupted by both regulators, and thus the heating element connected to the two regulators is entirely shut off. If only one regulator is switched by the associated switching mechanism 151 or 151', the temperature is regulated in the setpoint temperature range associated with the switched regulator. If both regulators are in operation, due to the parallel connection of the two regulators, the temperature is regulated to the higher setpoint value.

As follows further from the cutaway representation of the regulators 101, 101', the control arms 112, 112 extend from an opening 152, 152' placed between the base plate 107, 150 and the regulator socket 102, 102', which simultaneously creates a certain guidance for the control arm 112, 112' against rotating together with the steel plates.

It is furthermore to be drawn from FIG. 14 that the common base plate 150 extends laterally beyond the socket 102, 102' of the regulators 101, 101', and the length of projection Z, Z' of the control arm 112, 112' is less than the length of projection U, U' of the base plate 150. In this way, the forces of the switching mechanism directed toward the base plate can effectively be absorbed.

We claim:

1. In a thermically controlled switching unit of type comprising a socket having arranged therein in parallel orientation a bimetallic spring plate and a further plate, said spring plate being adapted to deflect in a first direction upon occurrence of a first spring temperature and to deflect in a second direction opposite said first direction, upon occurrence of a second spring temperature diverse from said first spring temperature, said further plate being deflectable in said first direction by said spring plate upon such first direction deflection thereof and being also deflectable in said second direction, and a switch element operable upon such first direction deflection of said further plate to be placed in first state and otherwise in a second state diverse from such first state, the improvement comprising a control element connected to said further plate for deflecting said further plate in said second direction.

2. The invention claimed in claim 1 characterized in that said unit is a temperature limiter, and in that said further plate is a bistable spring plate.

3. The invention claimed in claim 1 characterized in that said unit is a temperature regulator, and in that said further plate is a monostable spring plate.

4. The invention claimed in claim 3 further including a trip mechanism disposed in operating relation relative to said control element.

5. The invention claimed in claim 3 characterized in that said further plate is arranged between said bimetallic spring plate and said control element.

6. The invention claimed in claim 3 characterized in that said control element projects laterally out of said socket.

7. The invention claimed in claim 6 further including a heat-conducting base plate and characterized in that said control element projects through an opening arranged between said heat-conducting base plate and said socket.

8. The invention claimed in claim 6 characterized in that said control element is elongate and said switch element includes an elongate moving contact, wherein the longitudinal direction of said control element extends approximately at right angles to the longitudinal direction of said moving component of said switch element.

9. The invention claimed in claim 1 characterized in that said control element is attached by an end flat thereof against the periphery of said further plate.

10. The invention claimed in claim 1 wherein said further plate is circular and characterized in that said control element projects into said further plate to about half of the radius thereof.

11. The invention claimed in claim 1 wherein said further plate is circular and characterized in that said control element extends radially from such further plate perimeter, and the length of its projection from the plate perimeter corresponds approximately to the plate radius.

12. The invention claimed in claim 1 characterized in that said control element is a spring-metal strip having an end which is glued, welded or soldered to said further plate.

13. The invention claimed in claim 1 characterized in that said control element extends approximately at right angles to the surface of said further plate.

14. The invention claimed in claim 3 wherein said housing is pot-shaped and encloses said bimetallic plate and said further plate and characterized in that said control element projects out of said housing.

15. The invention claimed in claim 14 characterized in that said control element is Z-shaped and wherein a first limb of such Z is flat with the peripheral area of said further plate, a second Z limb runs approximately parallel to a cylindrical section of said housing, and a third limb of said Z projects from said housing as an actuating end of said control element.

16. The invention claimed in claim 1 characterized in that said control element and said further plate are integral.

17. The invention claimed in claim 1 wherein said further plate is circular and characterized in that said control element constitutes approximately 15% to 35% of the plate diameter.

18. The invention claimed in claim 3 further including a heat-conducting plate and a trip mechanism and characterized in that two such switching units are arranged in parallel configuration beside one another on said heat-conducting plate, and said trip mechanism is operably engageable with the control element of each of said switching units.

19. The invention claimed in claim 18 characterized in that said heat-conducting plate extends outward beyond the sockets of said switching units, and the lengths of said control elements therebeyond is less than or equal to the length of such outward extent of said heat-conducting plate.

20. The invention claimed in claim 3, characterized in that said bimetallic plate and said further plate are mounted eccentrically in a housing which is approximately a flattened rectangle, through which pass two essentially parallel, longitudinally displaceable such control elements and on which are supported push buttons connected to said control elements.

21. The invention claimed in claim 20 characterized in that one such push button is positioned in one recessed slot in said housing, and another such push button is positioned in a second housing slot, with such two housing slots parallel to one another.

22. The invention claimed in claim 21 wherein each said push button comprises a spring tongue having first and second ends and a middle region between said ends, said first end being attached fixedly in one of said housing slots, said second end projecting out of such slot and said middle region being in operating relation relative to one of said control elements.

23. In combination, in a thermically controlled switching unit, a steel spring plate deflectable in first and second opposite directions, a bimetallic element engaging said steel spring plate centrally thereof, an electrical switch having a movable contact, said steel spring plate also engaging said movable contact, a control arm having one end fixedly attached to a peripheral zone of said steel spring plate and a having second end, and a cutoff switch, said control arm second end being in operating relation relative to said cutoff switch.

24. The invention claimed in claim 22 wherein said control arm second end constitutes a member of said cutoff switch.

* * * * *